US007525252B2

(12) United States Patent
Iorio et al.

(10) Patent No.: US 7,525,252 B2
(45) **Date of Patent: *Apr. 28, 2009**

(54) SEALING TUBE MATERIAL FOR HIGH PRESSURE SHORT-ARC DISCHARGE LAMPS

(75) Inventors: Luana E. Iorio, Clifton Park, NY (US); Bruce A. Knudsen, Amsterdam, NY (US); Bernard P. Bewlay, Schenectady, NY (US); James S. Vartuli, Rexford, NY (US); Timothy J. Sommerer, Ballston Spa, NY (US)

(73) Assignee: General Electric Company, Schenectady, NY (US)

( * ) Notice: Subject to any disclaimer, the term of this patent is extended or adjusted under 35 U.S.C. 154(b) by 887 days.

This patent is subject to a terminal disclaimer.

(21) Appl. No.: 10/331,046

(22) Filed: Dec. 27, 2002

(65) Prior Publication Data

US 2004/0124776 A1 Jul. 1, 2004

(51) Int. Cl.
*H01J 17/18* (2006.01)
*H01J 61/36* (2006.01)
*H01J 17/00* (2006.01)

(52) U.S. Cl. ..... 313/625; 313/623; 313/567; 313/326

(58) Field of Classification Search ..... 313/625
See application file for complete search history.

(56) References Cited

U.S. PATENT DOCUMENTS 3,570,106 A 3/1971 McGurty et al.
3,774,064 A * 11/1973 Vause ..... 313/316
4,011,480 A 3/1977 Jacobs et al.
4,019,078 A * 4/1977 Burgess ..... 313/623
4,342,938 A * 8/1982 Strok ..... 313/565
4,366,410 A 12/1982 Buhrer
4,837,480 A * 6/1989 Breeze et al. ..... 313/346 DC
5,001,396 A 3/1991 Snellgrove et al.
5,263,349 A 11/1993 Felix et al.
5,404,078 A * 4/1995 Bunk et al. ..... 313/625
5,424,609 A 6/1995 Geven et al.
5,437,744 A * 8/1995 Carlen ..... 148/423
5,552,670 A 9/1996 Heider et al.
6,066,918 A * 5/2000 Suzuki et al. ..... 313/623
6,102,979 A * 8/2000 Bianco et al. ..... 75/232
6,181,065 B1 * 1/2001 Huettinger et al. ..... 313/625
6,194,832 B1 * 2/2001 Juengst ..... 313/625

(Continued)

FOREIGN PATENT DOCUMENTS

EP 0 632 479 1/1995

OTHER PUBLICATIONS

Eck RL Molybdaen-Rhenium Legierungen Als Schweissbare Hoch-Temperatur-Konstructionswerkstoffe., Int. J. Refract Hard Met Mar. 1986, vol. 5, No. 1, Mar. 1986, pp. 43-48, XP009055943—Abstract.

(Continued)

*Primary Examiner*—Nimeshkumar D. Patel
*Assistant Examiner*—Natalie K Walford
(74) *Attorney, Agent, or Firm*—Fay Sharpe LLP

(57) ABSTRACT

The present invention is directed to the use of a molybdenum-rhenium alloy in the construction of sealing tubes for high pressure discharge lamps.

20 Claims, 2 Drawing Sheets

U.S. PATENT DOCUMENTS

| | | | | |
|---|---|---|---|---|
| 6,404,130 | B1 * | 6/2002 | Dinter | 313/630 |
| 6,433,479 | B1 | 8/2002 | Higashimoto et al. | |
| 6,635,993 | B1 * | 10/2003 | Niimi | 313/623 |
| 6,705,915 | B2 * | 3/2004 | Ricaud et al. | 445/50 |
| 6,771,014 | B2 * | 8/2004 | Longo et al. | 313/346 DC |
| 7,215,081 | B2 * | 5/2007 | Bewlay et al. | 313/623 |
| 2002/0060520 | A1 | 5/2002 | Niimi | |
| 2002/0185974 | A1 | 12/2002 | Nakano et al. | |

OTHER PUBLICATIONS

Patent Abstract of Japan, vol. 1995, No. 11, Dec. 26, 1995 & JP 07 228940 (Tokyo Tungsten Co. Ltd) Aug. 28, 1995.
European Search Report.

* cited by examiner

SEALING TUBE MATERIAL FOR HIGH PRESSURE SHORT-ARC DISCHARGE LAMPS

BACKGROUND OF THE INVENTION

1. Field of the Invention

The present invention is directed to the use of a molybdenum-rhenium alloy in the construction of sealing tubes for high pressure discharge lamps.

2. Discussion of the Art

This invention relates to sealing tubes for use in high density polycrystalline ceramic bodies and, more particularly, to the sealing of high pressure discharge lamps. In particular, the invention relates to sealing tubes made from a molybdenum-rhenium alloy for sealing of high pressure discharge lamps such as high pressure arc discharge lamps.

Electrical discharge devices, such as high pressure short-arc lamps, commonly utilize transparent or translucent high temperature refractory tubes composed of, for example, alumina. Within the alumina tube an electric arc extends between two electrodes to which current is conducted by a hermetically sealed feed-through assembly. Because alumina and niobium metal have similar thermal coefficients of expansion, this is one factor for choosing niobium feedthroughs in high pressure short-arc discharge lamps to conduct electrical current through the ends of the alumina arc tube.

Recently, there have been demands for greater lighting power in short-arc discharge lamps. To satisfy these demands, it has become necessary to increase the amount of gas, such as mercury, scaled into the light-emitting tube, leading to the problem that, when the amount of gas sealed into the light-emitting tube of short-arc discharge lamps is increased, the pressure of the gas sealed within the light-emitting bulb increases to perhaps 145 psi or more (and could be as high as 2,500 psi) when the lamp is lit. Thus, the need for materials which are able to withstand the high pressures being generated in such lamps is increasing. In addition, such materials must also be resistant to attack by halides used in the dose of discharge lamps.

Pure molybdenum can be used in the manufacture of sealing tubes for high pressure discharge lamps due to its resistance to attack by halides which are typically used in the dose of short-arc discharge lamps. However, pure molybdenum does not possess sufficient ductility to allow sealing of the sealing tube by mechanical crimping. A pure molybdenum tube will normally crack on mechanical crimping to seal the tube due to the large deformation strain involved in the mechanical crimping process.

As such, a need for new materials exists, with respect to materials used to produce sealing tubes for use in high pressure halogen containing discharge lamps, wherein the material is resistant to halide attack, can withstand the high pressures and temperatures generated within discharge lamps and possesses sufficient ductility to deform without cracking during mechanical crimping operations to form hermetic sealing of sealing tubes.

BRIEF SUMMARY OF THE INVENTION

In accordance with a first aspect of the invention, a sealing tube constructed of a molybdenum-rhenium alloy is provided.

A further aspect of the invention relates to a sealing tube for use in high pressure halogen containing discharge lamps, such as short-arc high pressure discharge lamps and ceramic metal-halide lamps, wherein the sealing tube is constructed of a molybdenum-rhenium alloy.

Another aspect of the invention relates to a molybdenum-rhenium alloy which comprises about 35 to 55 wt. % rhenium.

An additional aspect of the invention relates to a method for increasing the linear thermal expansion coefficient of molybdenum by combining the molybdenum with rhenium to form a molybdenum-rhenium alloy.

A further aspect of the invention relates to a method for altering the ductility and hardness of a molybdenum-rhenium alloy comprising heat treating the molybdenum-rhenium alloy.

Another aspect of the invention relates to high pressure discharge lamps, including short arc-halide containing high pressure discharge lamps and ceramic metal-halide lamps, which contain a sealing tube constructed from a molybdenum-rhenium alloy.

These and other aspects and objects of the invention will become apparent upon reading and understanding the detailed description of the invention.

BRIEF DESCRIPTION OF THE DRAWINGS

The invention may take form in various components and arrangements of components, and in various steps and arrangement of steps. The drawings, in which like reference numerals denote like components through the views, are only for purpose of illustrating particular embodiments and are not to be construed as limiting the invention.

DETAILED DESCRIPTION OF THE INVENTION

A polycrystalline ceramic body, such as a high pressure discharge tube, having a cavity, is sealed with a molybdenum alloy and a sealing material to form a vacuum-tight assembly. Polycrystalline alumina, having an average thermal expansion coefficient of $8.1\times10^{-6}$°/C. between the temperatures of 25° C. and 1000° C., is commonly used for discharge tubes in high pressure discharge lamps. Yttria, having an average thermal expansion coefficient of $8.5\times10^{-6}$°/C. between 25° C. and 1000° C., is also used in the fabrication of discharge tubes. Furthermore, yttrium aluminum garnet, or YAG, having an average thermal expansion coefficient of $8.35\times10^{-6}$° C. between 25° C. and 1,000° C., is also used in the fabrication of discharge tubes.

The operational temperature of the seal region of high pressure discharge lamps is typically between ambient temperature, or about 25° C., when the device is turned off from about 700° C. to about 1400° C. when fully warmed up. To avoid cracking or other destruction of the hermetic seal between the ceramic body and the closure member, it is necessary that the closure member and the sealing material have thermal coefficients of expansion closely matched to the thermal coefficient of expansion of the ceramic body over the operating temperature range of the seal region. While high pressure discharge lamps have a typical operating temperature range between about 25° C. and about 1400° C., other vacuum-tight assemblies according to the present invention can experience greater or lesser operating temperature ranges and thus require matching of thermal expansion coefficients over a correspondingly greater or lesser temperature range. The closure members and the sealing material should have thermal coefficients of expansion which are close to the thermal coefficient of expansion of the ceramic body to provide a reliable seal and to relieve the mechanical stresses that arise due to differences in thermal expansion coefficients.

Figure 1:
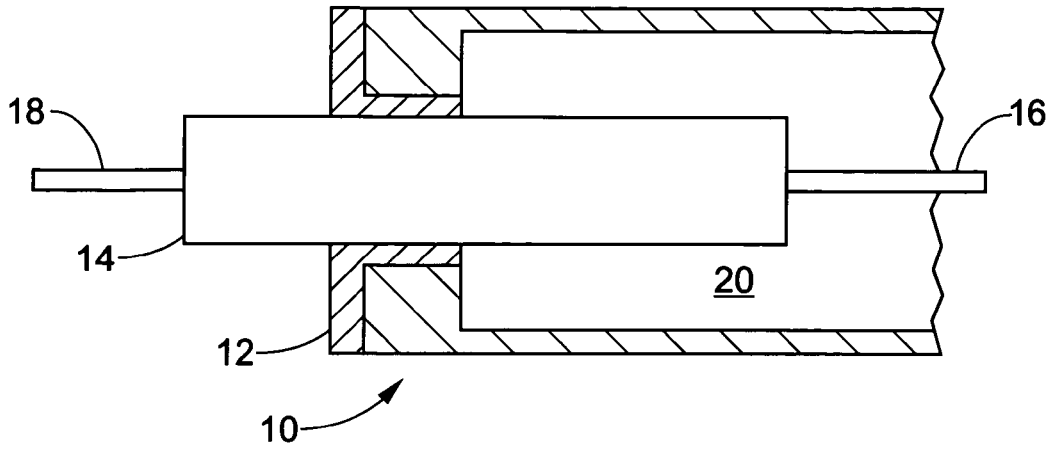
FIG. 1 shows a cross-sectional view of a vacuum tight assembly comprising a sealing tube according to the present invention.

According to the present invention a discharge lamp 10 assembly comprising a ceramic, cermet or metal plate end plug 12 having a sealing tube 14 is provided to form a vacuum tight assembly as shown in FIG. 1. An electrode rod 16 formed from a material such as tungsten extends from the seal tube 14 into a gas filled cavity 20 of the discharge lamp 10. The electrode may be welded to the seal tube 14. A connection lead 18 extends from a portion of the sealing tube 14 which is outside the discharge lamp assembly 10. The sealing tube is crimped after filling the lamp with gas and subsequently spot welded. In an alternative embodiment, the sealing tube can simply be welded without mechanical crimping.

Figure 2:
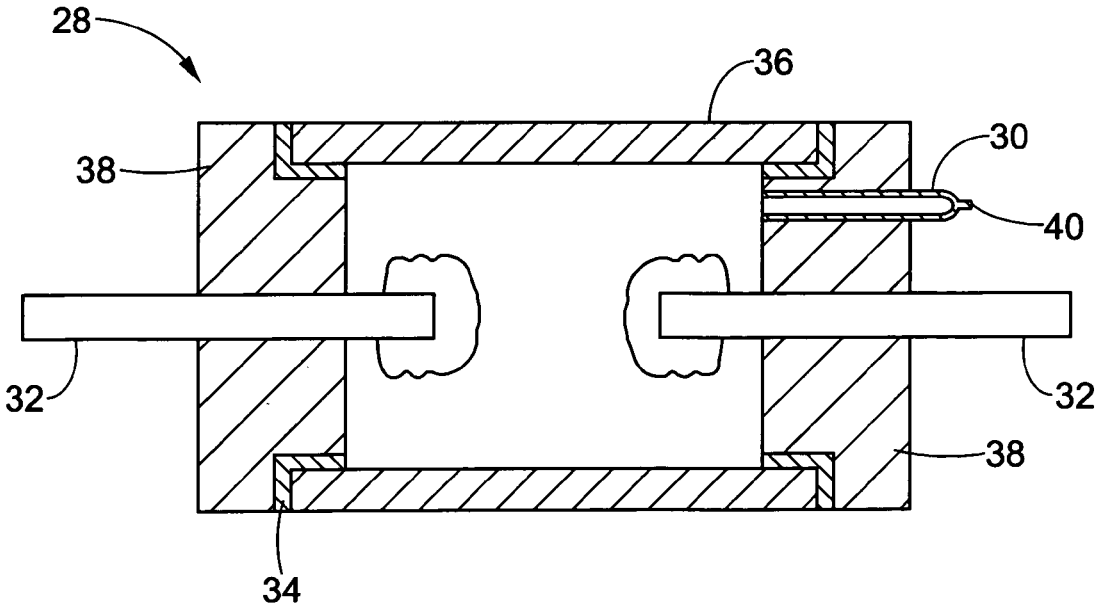
FIG. 2 shows a cross-sectional view of an alternative embodiment or a vacuum tight assembly comprising a sealing tube according to the present invention.

In an alternative embodiment, a discharge lamp assembly 28 is provided which comprises an offset sealing tube 30 (or dosing part) as shown in FIG. 2. The electrodes 32 may be made from materials such as tungsten (W). An end plug 38 seals each end of the ceramic arc tube 36 via a sealing material 34. The sealing tube 30, after dosing the discharge lamp, can then be sealed by mechanical crimping at the sealing tube end 40 and, subsequently, spot welding the mechanical crimp. Alternatively, the sealing tube can simply be welded without mechanical crimping.

Figure 3:
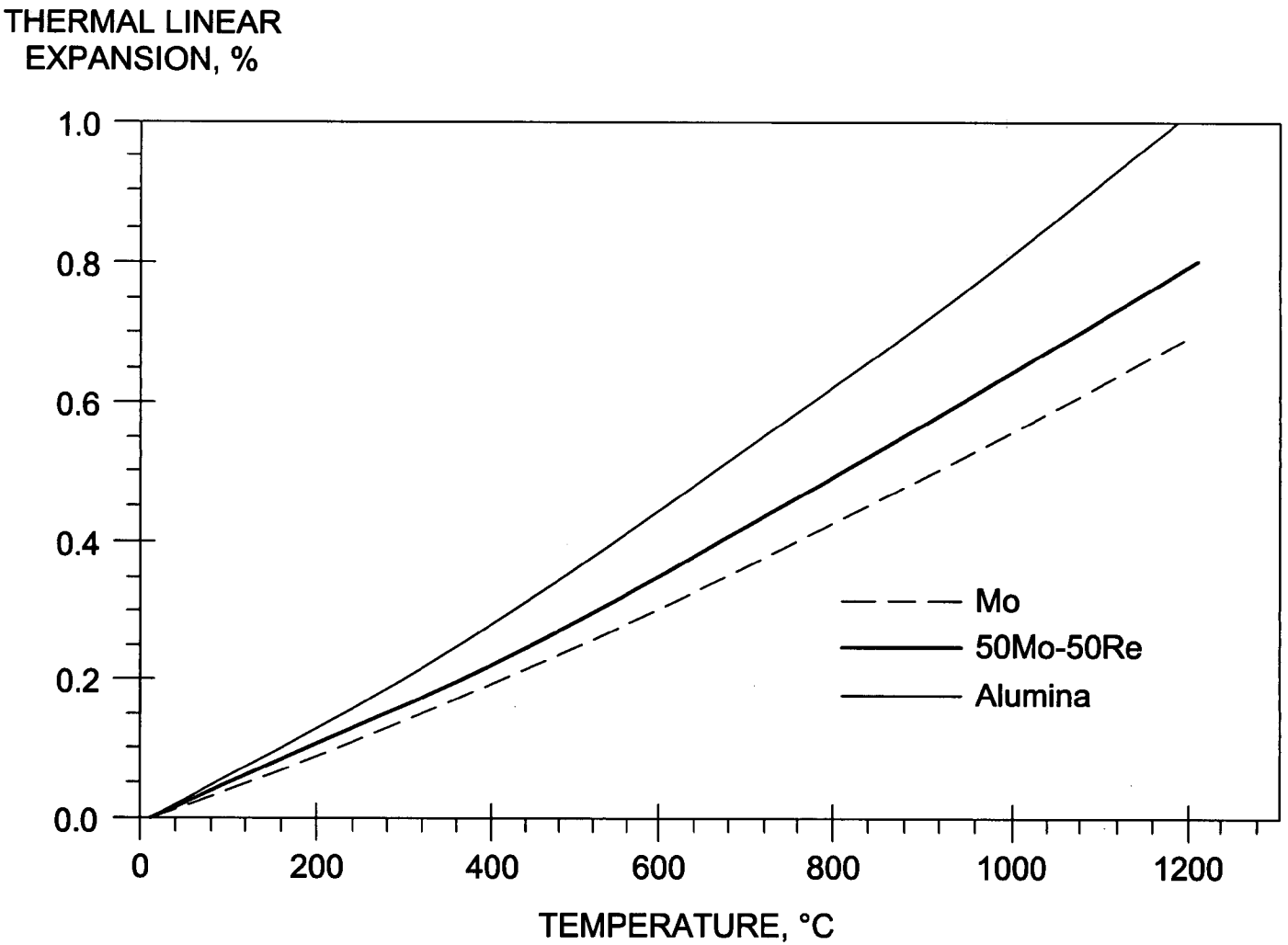
FIG. 3 shows a graphic diagram illustrating the linear thermal expansion of coefficients of molybdenum, a molybdenum-rhenium alloy and alumina versus temperature.

According to the present invention, molybdenum is alloyed with rhenium to form a sealing tube for a discharge lamp. Molybdenum, a refractory metal, has an average thermal expansion coefficient which is lower than that of rhenium. By properly selecting the ratio of each of molybdenum and rhenium used in the alloy, the thermal expansion coefficient of the molybdenum can be increased. The increased thermal expansion coefficient of the alloy is therefore closer to that of the materials used in the production of discharge lamps, such as alumina and other ceramic materials. FIG. 3 shows the thermal linear expansion of pure molybdenum, a 50-50 wt. % blend of a molybdenum-rhenium alloy, and polycrystalline alumina. Additionally, the use of Mo—Re provides for enhanced ductility while the Re has a favorable effect on thermal expansion.

Molybdenum-rhenium alloys with rhenium concentrations in the range of 35 to 55 wt. % are suitable for this application. The molybdenum-rhenium alloy is chosen for several reasons. While pure molybdenum is resistant to attack by halides, it does not possess sufficient ductility to allow sealing by crimping of molybdenum tube. A molybdenum tube cracks on crimping due to the large deformation strain involved. The molybdenum-rhenium alloy is resistant to halide attack and has much higher ductility than pure molybdenum. In the as-drawn condition, the molybdenum-rhenium alloy tube has much greater ductility than the pure molybdenum tube, however its ductility is still not sufficient for crimping.

In order to achieve a hermetic crimp seal, some heat treatment of the molybdenum-rhenium alloy is necessary to develop sufficient ductility and relieve the work hardening due to mechanical working such as drawing and extrusion. A heat treatment of 1200° C. for four hours was insufficient to substantially alter the molybdenum-rhenium alloy hardness and ductility. A heat treatment of from about 1200° C. to about 1900° C. for from about 0.5 hours to about four hours in a dry hydrogen atmosphere (dew point <−50° C.) results in a molybdenum-rhenium alloy which possesses greater ductility can be crimped without any evidence of cracking and can withstand pressures of at least about 2,000 psi. This Mo—Re alloy, after beat treatment, is useful in the production of sealing tubes for discharge lamps.

Tests have shown that Mo—Re tubing which has received a heat treatment of from about 1200° C. to about 1900° C. for from about 0.5 hours to about four hours in a dry hydrogen atmosphere (dew point <−50° C.) can be successfully crimped without any evidence of cracking. Burst tests on as-crimped tubes show that the seal is capable of withstanding 100 to 1,700 psi pressure, depending on the crimping pressure used. Crimped seals which had been secured with a laser weld at the crimp location, were able to withstand pressures in excess of 8,500 psi. These results indicate that Mo—Re tubing can be sealed with seals as good as those that have been achieved in niobium tubing used in conventional high pressure sodium products as shown in the Example below. The advantage of the Mo—Re alloy over the niobium is its increased halide resistance.

The following data demonstrates the ability to utilize the Mo—Re alloy in forming a seal tube which can be mechanically crimped according to the invention.

EXAMPLE 1 mm OD×0.5 mm ID Mo—Re tubing comprising 47.5 wt % Re was heat treated at 1,800° C. for two hours prior to mechanical crimping to seal the tube. In some cases laser welding of the crimped area was done to reinforce the mechanical seal. The Mo—Re tubing seals were tested in an apparatus that applies water pressure of up to 10,000 psi to the inside of the tubing. The pressure at which water escapes through the seal is noted as the burst pressure below.

TABLE 1

Burst Pressure results from crimped Mo—Re tubing compared to crimped Nb tubing

| SAMPLE | BURST PRESSURE |
|---|---|
| Mo—Re Tubing Seal with mechanical crimp and laser weld 1 | >4,000 psi* |
| Mo—Re Tubing Seal with mechanical crimp and laser weld 2 | >8,500 psi |
| Mo—Re Tubing Seal with mechanical crimp and laser weld 3 | >4,000 psi* |
| Mo—Re Tubing Seal with mechanical crimp and laser weld 4 | 2,000 psi* |
| Mo—Re Tubing Seal with mechanical crimp 1 | 1,000 psi |
| Mo—Re Tubing Seal with mechanical crimp 2 | 1,000 psi |
| Mo—Re Tubing Seal with mechanical crimp 3 | 1,500 psi |
| Mo—Re Tubing Seal with mechanical crimp 4 | 500 psi |
| Niobium Tubing Seal with mechanical crimp | 500, 1,200, 2,000, 2,000, 2,500, 1,000, 2,000, 500 psi |
| Niobium Tubing Seal with mechanical crimp and laser weld | >10,000 psi |

*Other parts of the sealing tube gave out prior to bursting of the mechanical crimp/laser weld.

While the niobium tube had a slight increase in resistance to bursting compared to the Mo—Re alloy tube of the invention, the Mo—Re tubing has the advantage of increased halide resistance compared to the niobium while being able to withstand pressures comparable to that of niobium.

Other advantages which can be obtained from the use of the molybdenum rhenium alloy of the present invention include, but are not limited to, the ability to deform without cracking during crimping operations enabling hermetic sealing and the ability to withstand the high temperatures that are developed within the lamp.

While the invention has been described herein relative to its preferred embodiments, it is of course contemplated that modifications of, and alternatives to, these embodiments, such modifications and alternatives obtaining the advantages and benefits of this invention, will be apparent to those of ordinary skill in the art having reference to this specification. It is contemplated that such modifications and alternatives are within the scope of this invention, as subsequently claimed herein.

What is claimed is:

1. A crimped sealing tube constructed from a material comprising a molybdenum-rhenium alloy having a rhenium concentration of from about 35 wt. % to about 55 wt. %, and including at last one end sealed by a crimp.

2. The crimped sealing tube of claim 1 wherein the sealing tube further includes a welded seal.

3. The crimped sealing tube of claim 2 wherein the sealing tube can withstand pressure at least about 2000 psi.

4. The crimped sealing tube of claim 2 wherein the sealing tube can withstand pressure of from about 100 psi to about 1,700 psi.

5. The crimped sealing tube of claim 2 wherein the crimped seal has been welded at the crimp after crimping.

6. The crimped sealing tube of claim 5 wherein the weld is a laser weld.

7. The crimped sealing tube of claim 6 wherein the sealing tube can withstand pressures of at least 9,000 psi.

8. The crimped sealing tube of claim 1 wherein the molybdenum-rhenium alloy has a linear thermal expansion % which is greater than that of molybdenum alone over a temperature range of from 0° C. to about 1200° C.

9. A halide containing discharge lamp comprising a crimped sealing tube wherein said sealing tube is constructed from a material comprising a molybdenum-rhenium alloy having a rhenium concentration of from about 35 wt. % to about 55 wt. % and includes at least one end sealed by a crimp.

10. A discharge lamp comprising a crimped sealing tube of claim 2.

11. A discharge lamp comprising a crimped sealing tube of claim 5.

12. A discharge lamp comprising a crimped sealing tube of claim 6.

13. The crimped sealing tube of claim 9 further including a seal weld.

14. The sealing tube of claim 1 wherein the molybdenum rhenium alloy is heat treated at a temperature of about 1200° C. to about 1900° C. before crimping.

15. The discharge lamp of claim 9, wherein the crimped sealing tube can withstand pressure above at least about 2000 psi.

16. A crimped sealing tube constructed from a material comprising a molybdenum-rhenium alloy and including at last one end sealed by a crimp and further including a welded seal.

17. The crimped sealing tube of claim 16 wherein the sealing tube can withstand pressure of from about 100 psi to about 1,700 psi.

18. The crimped sealing tube of claim 16 wherein the sealing tube can withstand pressure of least about 9000 psi.

19. The crimped sealing tube of claim 16 wherein the welded seal is located at the crimped seal.

20. The crimped sealing tube of claim 16 wherein the weld is a laser weld.

* * * * *